US006694721B2

(12) United States Patent
Gomez

(10) Patent No.: US 6,694,721 B2
(45) Date of Patent: Feb. 24, 2004

(54) DECORATIVE CHAIN ELEMENT

(75) Inventor: Luis Gomez, Soisy Sous Montmorency (FR)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 10/169,494

(22) PCT Filed: Jan. 5, 2001

(86) PCT No.: PCT/FR01/00032

§ 371 (c)(1),
(2), (4) Date: Aug. 2, 2002

(87) PCT Pub. No.: WO01/50905

PCT Pub. Date: Jul. 19, 2001

(65) Prior Publication Data

US 2003/0051459 A1 Mar. 20, 2003

(30) Foreign Application Priority Data

Jan. 11, 2000 (FR) ..... 00 00275

(51) Int. Cl.[7] ..... F16G 13/00
(52) U.S. Cl. ..... 59/80; 59/82; 59/93
(58) Field of Search ..... 59/2, 3, 80, 82, 59/85, 93

(56) References Cited

U.S. PATENT DOCUMENTS

| | | | | | |
|---|---|---|---|---|---|
| 1,092,427 | A | * | 4/1914 | Brassler | 59/80 |
| 1,116,910 | A | * | 11/1914 | Oexle | 59/80 |
| 3,385,050 | A | | 5/1968 | Hall | |
| 4,671,055 | A | * | 6/1987 | Tschanz et al. | 59/80 |
| 5,155,990 | A | * | 10/1992 | Poll | 59/80 |
| 6,220,010 | B1 | * | 4/2001 | Gomez | 59/80 |
| 6,220,011 | B1 | * | 4/2001 | Dalferth et al. | 59/85 |

FOREIGN PATENT DOCUMENTS

| | | |
|---|---|---|
| DE | 1 460 162 A | 3/1969 |
| FR | 1.128.579 A | 1/1957 |
| FR | 2 779 921 A | 12/1999 |
| GB | 2 069 817 A | 9/1981 |

* cited by examiner

*Primary Examiner*—David Jones
(74) *Attorney, Agent, or Firm*—Oliff & Berridge PLC

(57) ABSTRACT

An ornamental chain element having a hollow body constituted by two complementary portions (3; 4) provided with co-operating internal snap-fastening members (5–6; 8–11). The hollow body is shaped to retain at least one link member (14; 15) for linking it to an adjacent element of the chain, and contains internally a locking member (12) for locking the snap-fastening means in their assembled position.

8 Claims, 2 Drawing Sheets

DECORATIVE CHAIN ELEMENT

The present invention relates to an ornamental chain element made up of successive elements of generally spherical shape, for example, having the same or different dimensions, and made of metal, preferably a precious metal, e.g. gold.

It is known to make a chain of beads by means of a method consisting: in chasing the metal of a wire at regular intervals to form enlarged zones presenting a region of narrow section halfway along; in envelopping each of the enlarged zones in a sheet of metal shaped to form a bead; and then in breaking the wire in the narrow section portion of each enlarged zone inside a bead.

That method is not particularly well adapted to making an ornamental chain, in particular because beads made in that way lend themselves poorly to mounting precious stones.

In FR-A-2 779 921, the Applicant company describes an ornamental chain made up of successive elements characterized by the fact that at least one of the elements of the chain comprises a hollow body having fixed therein an insert shaped to retain a link member connected to an adjacent element of the chain, the insert being constituted by at least one split sleeve, the sleeve being of a shape that is sufficiently wide to allow the body of the link member to pass through.

The present invention proposes making an ornamental chain element suitable for an assembly process that is even faster than with the chain elements of the prior document and that provides the assembled elements with greater strength, particularly against any attempt at pulling off the chain.

The chain element of the invention is essentially characterized by the fact that it comprises a hollow body made up of two complementary portions provided with co-operating internal snap-fastening means, the hollow body being shaped to retain at least one link member for linking it to an adjacent element of the chain, and containing an internal locking member for locking the snap-fastening means in their assembled position.

Advantageously, the means for snap-fastening the two hollow body portions together comprise tongues projecting from one of the hollow body portions, each being provided with a catch-forming end suitable for engaging against a retaining bearing surface formed in the other hollow body portion. Said other hollow body portion may advantageously include a recess in which a tubular locking member is received, said locking member being positioned and shaped so that during assembly of the two portions of the hollow body it presses the ends of said tongues outwards, thereby locking them in the assembled position.

The locking member may be made of the same material as the hollow body and act during assembly to deform the ends of the tongues so that the tongues are, so to speak, riveted against their bearing surface.

The two portions of the hollow body of the invention include cutouts in their outer walls for receiving link members and retaining them in the hollow body after the two component portions thereof have been assembled together.

The invention can accommodate a wide variety of shapes for the hollow body, and it can advantageously be spherical, being made by turning, and it may be suitable for receiving a precious stone mounted in a blind hole formed in one of the portions of the hollow body.

As in the above-mentioned prior document in the name of the Applicant company, the link member may be constituted by a peg having two heads.

Other advantages and characteristics of the present invention appear on reading the following description of a non-limiting embodiment given with reference to the accompanying drawings, in which.

Figure 1:
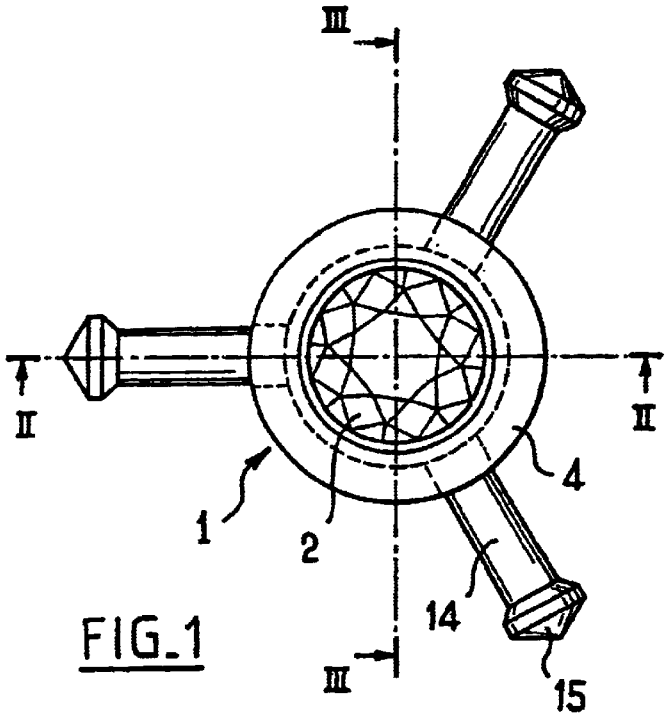
FIG. 1 is a plan view of an element of an ornamental chain of the invention, provided with three link members for linking to adjacent elements.

The drawings show an embodiment of the element of the invention which is spherical in shape, being given overall reference 1 and having a precious stone 2 mounted therein, which element can be made of gold or some other precious metal.

The element of the invention is a hollow body made by assembling together two portions 3 and 4, each having an outer profile that is spherical, the two portions constituting an element 1 of generally spherical shape once they have been assembled together.

For mutual fastening, the elements 3 and 4 include co-operating locking means that act by snap-fastening.

These means comprise tongues 5, of which there are three in the example shown, projecting from the portion 3 and distributed at equal angles, said tongues 5 each having a catch 6 at its end.

Figure 5:
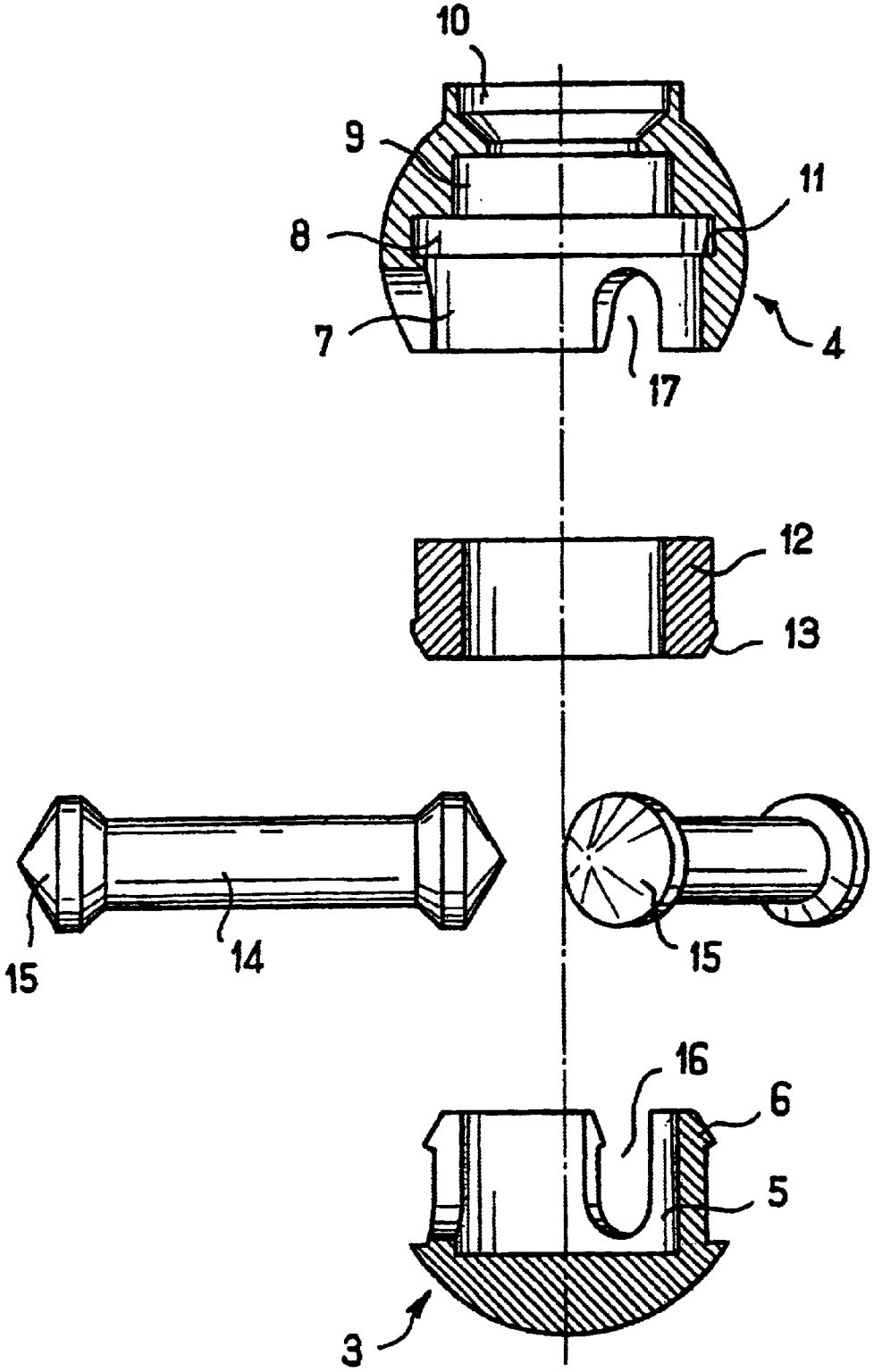
FIG. 5 is an exploded view corresponding to FIG. 2 showing the components of the element of the invention prior to assembly.

As can be seen more clearly in FIG. 5, the portion 4 of the element 1 that is complementary to the portion 3 thereof includes a succession of cylindrical cavities 7, 8, 9 of different diameters together with a blind hole 10 that is partially frustoconical in shape for receiving and mounting the precious stone 2.

Figure 4:
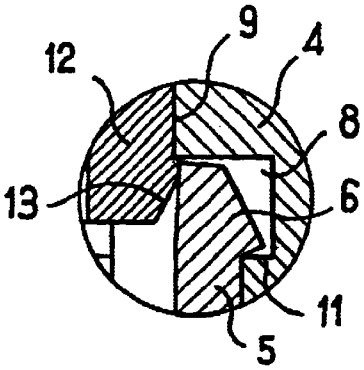
FIG. 4 is an enlarged view showing a detail A of FIG. 2.

The cavity 7 is dimensioned so as to guide and receive the tongues 5 of the element 3, with the stepped bearing surface 11 between the cavities 7 and 8 constituting the bearing surface beyond which the catch-forming end 6 of each tongue 5 snap-fastens when said end is received in the cavity 8, as can be seen more clearly in FIG. 4.

As can be seen FIG. 5, the cavity 8 is extended by a cavity 9 of smaller diameter in which there can be received as a tight-fit a ring 12 provided with a chamfered end 13.

Figure 3:
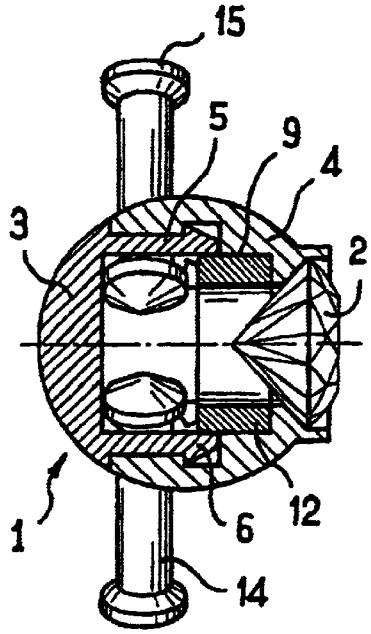
FIG. 3 is a section view on III—III of FIG. 1.
Figure 2:
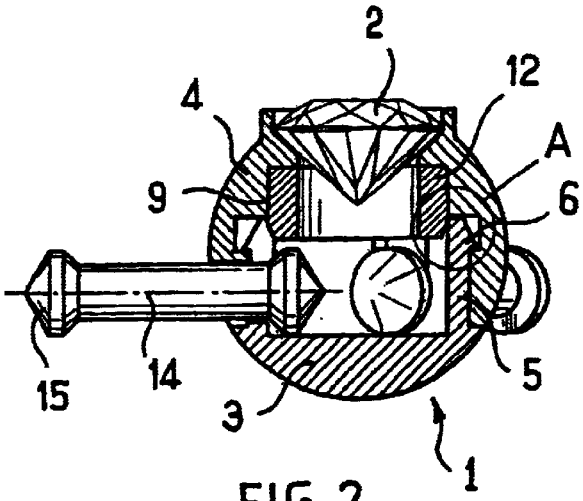
FIG. 2 is a section view on II—II of FIG. 1.

As can be seen in particular in FIGS. 2 to 4, the ring 12 is received in the cavity 9 with its chamfered end 13 projecting into the cavity 8 which is to receive the catch-forming ends 6 of the tongues 5.

As can be seen in FIG. 4, during assembly of the portions 3 and 4 and mutual locking by snap-fastening, the inside faces of the tongues 5 slide against the chamfered portion 13 of the annular locking member constituted by the ring 12 and are urged outwards, thereby deforming the catch-forming ends 6 of the tongues outwards and ensuring that the snap-fastening means are prevented from moving.

This effect whereby the ends of the tongues are "riveted" ensures that the two mechanical portions making up the chain element of the invention are held together securely, providing excellent ability to withstand attempts at tearing off the chain.

For linking to adjacent elements in an ornamental chain, the element of the invention is suitable for receiving cylindrical pegs 14 each provided with two heads 15 each in the form of a double cone.

To receive the pegs 14, the portions 3 and 4 of the chain element of the invention have respective notches 16 and 17 that are in alignment in the assembled position, and that have the pegs 14 engaged therein so as to be retained in the inside cavity of the element while being free to move in many ways while nevertheless being prevented from escaping from the cavity.

Although the invention is described above with reference to a particular embodiment, it is clear that the invention is not limited thereto and that variants and modifications can be made to the invention without thereby going beyond the ambit or the spirit of the invention.

Thus, although the example shows has three link members that are distributed at equal angles, it is entirely possible to envisage having an arbitrary number of such members that are distributed regularly or otherwise.

What is claimed is:

1. An ornamental chain element, comprising a hollow body made up of two complementary portions provided with co-operating internal snap-fastening means, the hollow body being shaped to retain at least one link member for linking it to an adjacent element of the chain, and containing an internal locking member for locking the snap-fastening means in their assembled position.

2. An ornamental chain element according to claim 1, wherein the means for snap-fastening the two hollow body portions together comprise tongues projecting from one of the hollow body portions, each being provided with a catch-forming end suitable for engaging against a retaining bearing surface formed in the other hollow body portion.

3. An ornamental chain element according to claim 2, wherein said other hollow body portion includes a recess in which a tubular locking member is received, said locking member being positioned and shaped so that during assembly of the two portions of the hollow body said locking member presses the ends of said tongues outwards, thereby locking them in the assembled position.

4. An ornamental chain element according to claim 1, wherein the two portions of the hollow body have notches in their outside walls for receiving the link members and for retaining the link members in the hollow body after said two portions have been assembled together.

5. An ornamental chain element according to claim 1, wherein the hollow body is spherical.

6. An ornamental chain element according to claim 1, wherein said hollow body is made of metal, and is made by turning.

7. An ornamental chain element according to claim 1, wherein each link member is constituted by a peg having two heads.

8. An ornamental chain element according to claim 1, wherein said chain element has a blind hole in one of the portions of the hollow body for mounting a precious stone.

* * * * *